US009143857B2

(12) United States Patent
Every et al.

(10) Patent No.: US 9,143,857 B2
(45) **Date of Patent: *Sep. 22, 2015**

(54) ADAPTIVELY REDUCING NOISE WHILE LIMITING SPEECH LOSS DISTORTION

(71) Applicant: Audience, Inc., Mountain View, CA (US)

(72) Inventors: Mark Every, Surrey (CA); Carlos Avendano, Campbell, CA (US)

(73) Assignee: Audience, Inc., Mountain View, CA (US)

( * ) Notice: Subject to any disclaimer, the term of this patent is extended or adjusted under 35 U.S.C. 154(b) by 275 days.

This patent is subject to a terminal disclaimer.

(21) Appl. No.: 13/888,796

(22) Filed: May 7, 2013

(65) Prior Publication Data

US 2013/0251170 A1 Sep. 26, 2013

Related U.S. Application Data

(63) Continuation of application No. 13/424,189, filed on Mar. 19, 2012, now Pat. No. 8,473,285, which is a continuation of application No. 12/832,901, filed on Jul. 8, 2010, now Pat. No. 8,473,287.

(60) Provisional application No. 61/325,764, filed on Apr. 19, 2010.

(51) Int. Cl.
*G10K 11/16* (2006.01)
*H04R 3/00* (2006.01)
(Continued)

(52) U.S. Cl.
CPC ..... *H04R 3/002* (2013.01); *G10L 21/0208* (2013.01); *G10L 25/18* (2013.01)

(58) Field of Classification Search
CPC ..... G10L 21/0208; G10L 25/18
USPC ..... 381/71.1
See application file for complete search history.

(56) References Cited

U.S. PATENT DOCUMENTS 8,046,219 B2 10/2011 Zurek et al.
8,107,656 B2 1/2012 Dreβler et al.
(Continued)

FOREIGN PATENT DOCUMENTS

TW 200933609 8/2009
TW 201205560 2/2012
(Continued)

OTHER PUBLICATIONS

International Search Report and Written Opinion mailed Jul. 5, 2011 in Patent Cooperation Treaty Application No. PCT/US11/32578.
(Continued)

*Primary Examiner* — Sonia Gay
(74) *Attorney, Agent, or Firm* — Carr & Ferrell LLP

(57) ABSTRACT

The present technology provides adaptive noise reduction of an acoustic signal using a sophisticated level of control to balance the tradeoff between speech loss distortion and noise reduction. The energy level of a noise component in a sub-band signal of the acoustic signal is reduced based on an estimated signal-to-noise ratio of the sub-band signal, and further on an estimated threshold level of speech distortion in the sub-band signal. In various embodiments, the energy level of the noise component in the sub-band signal may be reduced to no less than a residual noise target level. Such a target level may be defined as a level at which the noise component ceases to be perceptible.

22 Claims, 9 Drawing Sheets

(51) Int. Cl.
*G10L 21/0208* (2013.01)
*G10L 25/18* (2013.01)

(56) References Cited

U.S. PATENT DOCUMENTS

| | | | |
|---|---|---|---|
| 8,359,195 | B2 | 1/2013 | Li |
| 8,473,285 | B2 | 6/2013 | Every et al. |
| 8,473,287 | B2 | 6/2013 | Every et al. |
| 8,538,035 | B2 | 9/2013 | Every et al. |
| 2004/0047474 | A1 | 3/2004 | Vries et al. |
| 2008/0159573 | A1 | 7/2008 | Dressler et al. |
| 2009/0012783 | A1 | 1/2009 | Klein |
| 2009/0067642 | A1 | 3/2009 | Buck et al. |
| 2010/0067710 | A1 | 3/2010 | Hendriks et al. |
| 2010/0076769 | A1 | 3/2010 | Yu |
| 2011/0257967 | A1 | 10/2011 | Every et al. |
| 2012/0027218 | A1 | 2/2012 | Every et al. |
| 2012/0179461 | A1 | 7/2012 | Every et al. |
| 2013/0251170 | A1 | 9/2013 | Every et al. |
| 2013/0322643 | A1 | 12/2013 | Every et al. |

FOREIGN PATENT DOCUMENTS

| | | |
|---|---|---|
| TW | 201207845 | 2/2012 |
| TW | I466107 | 12/2014 |
| WO | WO2009035614 | 3/2009 |
| WO | WO2011133405 | 10/2011 |
| WO | WO2011137258 | 11/2011 |

OTHER PUBLICATIONS

International Search Report and Written Opinion mailed Jul. 21, 2011 in Patent Cooperation Treaty Application No. PCT/US11/34373.

Office Action mailed Jun. 5, 2014 in Taiwanese Patent Application 100115214, filed Apr. 29, 2011.

Office Action mailed Oct. 30, 2014 in Korean Patent Application No. 10-2012-7027238, filed Apr. 14, 2011.

Jung et al., "Feature Extraction through the Post Processing of WFBA Based on MMSE-STSA for Robust Speech Recognition," Proceedings of the Acoustical Society of Korea Fall Conference, vol. 23, No. 2(s), pp. 39-42, Nov. 2004.

Notice of Allowance dated Nov. 7, 2014 in Taiwanese Application No. 100115214, filed Apr. 29, 2011.

Office Action mailed Dec. 10, 2014 in Finnish Patent Application No. 20126083, filed Apr. 14, 2011.

Lu et al., "Speech Enhancement Using Hybrid Gain Factor in Critical-Band-Wavelet-Packet Transform", Digital Signal Processing, vol. 17, Jan. 2007, pp. 172-188.

ADAPTIVELY REDUCING NOISE WHILE LIMITING SPEECH LOSS DISTORTION

CROSS-REFERENCE TO RELATED APPLICATIONS

This application is a continuation of U.S. patent application Ser. No. 13/424,189, filed Mar. 19, 2012, now U.S. Pat. No. 8,473,285, which is a continuation of U.S. patent application Ser. No. 12/832,901, filed Jul. 8, 2010, now U.S. Pat. No. 8,473,287, which claims the benefit of U.S. Provisional Application No. 61/325,764, filed on Apr. 19, 2010. This application is related to U.S. patent application Ser. No. 12/832,920, filed Jul. 8, 2010, now U.S. Pat. No.8,538,035. The disclosures of the aforementioned applications are incorporated herein by reference.

BACKGROUND

1. Field of the Invention

The present invention relates generally to audio processing, and more particularly to adaptive noise reduction of an audio signal.

2. Description of Related Art

Currently, there are many methods for reducing background noise within an acoustic signal in an adverse audio environment. One such method is to use a stationary noise suppression system. The stationary noise suppression system will always provide an output noise that is a fixed amount lower than the input noise. Typically, the noise suppression is in the range of 12-13 decibels (dB). The noise suppression is fixed to this conservative level in order to avoid producing speech loss distortion, which will be apparent with higher noise suppression.

In order to provide higher noise suppression, dynamic noise suppression systems based on signal-to-noise ratios (SNR) have been utilized. This SNR may then be used to determine a suppression value. Unfortunately, SNR, by itself, is not a very good predictor of speech distortion due to existence of different noise types in the audio environment. SNR is a ratio of how much louder speech is than noise. However, speech may be a non-stationary signal which may constantly change and contain pauses. Typically, speech energy, over a period of time, will include a word, a pause, a word, a pause, and so forth. Additionally, stationary and dynamic noises may be present in the audio environment. The SNR averages all of these stationary and non-stationary speech and noise and determines a ratio based on what the overall level of noise is. There is no consideration as to the statistics of the noise signal.

In some prior art systems, an enhancement filter may be derived based on an estimate of a noise spectrum. One common enhancement filter is the Wiener filter. Disadvantageously, the enhancement filter is typically configured to minimize certain mathematical error quantities, without taking into account a user's perception. As a result, a certain amount of speech degradation is introduced as a side effect of the signal enhancement which suppress noise. For example, speech components that are lower in energy than the noise typically end up being suppressed by the enhancement filter, which results in a modification of the output speech spectrum that is perceived as speech distortion. This speech degradation will become more severe as the noise level rises and more speech components are attenuated by the enhancement filter. That is, as the SNR gets lower, typically more speech components are buried in noise or interpreted as noise, and thus there is more resulting speech loss distortion. This introduces more speech loss distortion and speech degradation.

Therefore, it is desirable to be able to provide adaptive noise reduction that balances the tradeoff between speech loss distortion and residual noise.

SUMMARY

The present technology provides adaptive noise reduction of an acoustic signal using a sophisticated level of control to balance the tradeoff between speech loss distortion and noise reduction. The energy level of a noise component in a sub-band signal of the acoustic signal is reduced based on an estimated signal-to-noise ratio of the sub-band signal, and further on an estimated threshold level of speech distortion in the sub-band signal. In embodiments, the energy level of the noise component in the sub-band signal may be reduced to no less than a residual noise target level. Such a target level may be defined as a level at which the noise component ceases to be perceptible.

A method for reducing noise within an acoustic signal as described herein includes receiving an acoustic signal and separating the acoustic signal into a plurality of sub-band signals. A reduction value is then applied to a sub-band signal in the plurality of sub-band signals to reduce an energy level of a noise component in the sub-band signal. The reduction value is based on an estimated signal-to-noise ratio of the sub-band signal, and further based on an estimated threshold level of speech loss distortion in the sub-band signal.

A system for reducing noise within an acoustic signal as described herein includes a frequency analysis module stored in memory and executed by a processor to receive an acoustic signal and separate the acoustic signal into a plurality of sub-band signals. The system also includes a noise reduction module stored in memory and executed by a processor to apply a reduction value to a sub-band signal in the plurality of sub-band signals to reduce an energy level of a noise component in the sub-band signal. The reduction value is based on an estimated signal-to-noise ratio of the sub-band signal, and further based on an estimated threshold level of speech loss distortion in the sub-band signal.

A computer readable storage medium as described herein has embodied thereon a program executable by a processor to perform a method for reducing noise within an acoustic signal as described above.

Other aspects and advantages of the present invention can be seen on review of the drawings, the detailed description, and the claims which follow.

DETAILED DESCRIPTION

Figure 1:
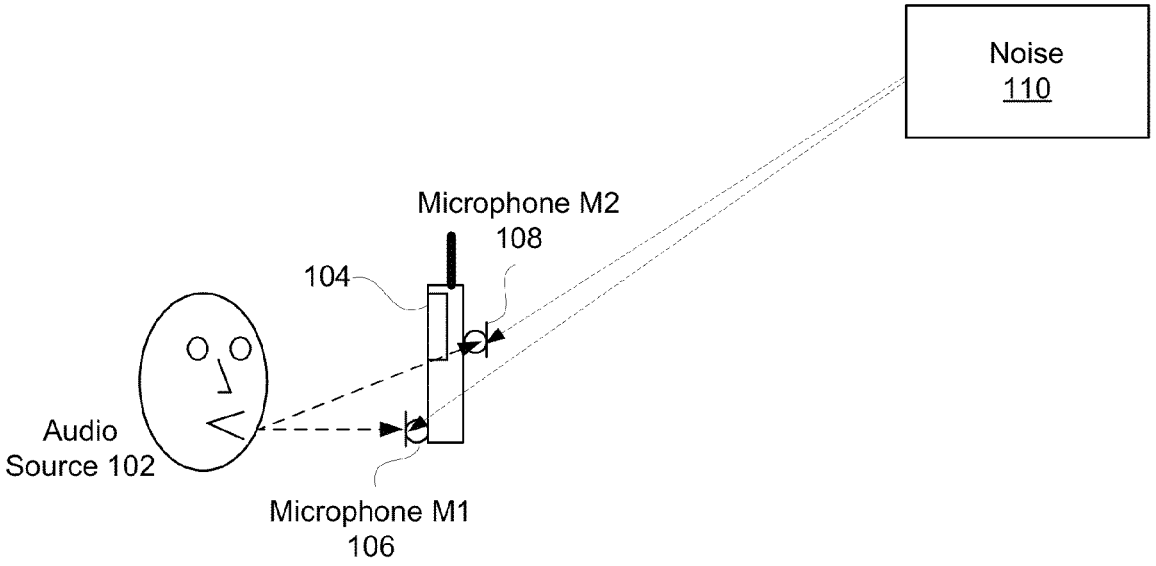
FIG. 1 is an illustration of an environment in which embodiments of the present technology may be used.

The present technology provides adaptive noise reduction of an acoustic signal using a sophisticated level of control to balance the tradeoff between speech loss distortion and noise reduction. Noise reduction may be performed by applying reduction values (e.g., subtraction values and/or multiplying gain masks) to corresponding sub-band signals of the acoustic signal, while also limiting the speech loss distortion introduced by the noise reduction to an acceptable threshold level. The reduction values and thus noise reduction performed can vary across sub-band signals. The noise reduction may be based upon the characteristics of the individual sub-band signals, as well as by the perceived speech loss distortion introduced by the noise reduction. The noise reduction may be performed to jointly optimize noise reduction and voice quality in an audio signal.

The present technology provides a lower bound (i.e., lower threshold) for the amount of noise reduction performed in a sub-band signal. The noise reduction lower bound serves to limit the amount of speech loss distortion within the sub-band signal. As a result, a large amount of noise reduction may be performed in a sub-band signal when possible. The noise reduction may be smaller when conditions such as an unacceptably high speech loss distortion do not allow for a large amount of noise reduction.

Noise reduction performed by the present system may be in the form of noise suppression and/or noise cancellation. The present system may generate reduction values applied to primary acoustic sub-band signals to achieve noise reduction. The reduction values may be implemented as a gain mask multiplied with sub-band signals to suppress the energy levels of noise components in the sub-band signals. The multiplicative process is referred to as multiplicative noise suppression. In noise cancellation, the reduction values can be derived as a lower bound for the amount of noise cancellation performed in a sub-band signal by subtracting a noise reference sub-band signal from the mixture sub-band signal.

The present system may reduce the energy level of the noise component in the sub-band to no less than a residual noise target level. The residual noise target level may be fixed or slowly time-varying, and in some embodiments is the same for each sub-band signal. The residual noise target level may for example be defined as a level at which the noise component ceases to be audible or perceptible, or below a self-noise level of a microphone used to capture the acoustic signal. As another example, the residual noise target level may be below a noise gate of a component such as an internal AGC noise gate or baseband noise gate within a system used to perform the noise reduction techniques described herein.

Some prior art systems invoke a generalized side-lobe canceller. The generalized side-lobe canceller is used to identify desired signals and interfering signals included by a received signal. The desired signals propagate from a desired location and the interfering signals propagate from other locations. The interfering signals are subtracted from the received signal with the intention of cancelling the interference. This subtraction can also introduce speech loss distortion and speech degradation.

Embodiments of the present technology may be practiced on any audio device that is configured to receive and/or provide audio such as, but not limited to, cellular phones, phone handsets, headsets, and conferencing systems. While some embodiments of the present technology will be described in reference to operation on a cellular phone, the present technology may be practiced on any audio device.

FIG. 1 is an illustration of an environment in which embodiments of the present technology may be used. A user may act as an audio (speech) source 102 to an audio device 104. The exemplary audio device 104 includes two microphones: a primary microphone 106 relative to the audio source 102 and a secondary microphone 108 located a distance away from the primary microphone 106. Alternatively, the audio device 104 may include a single microphone. In yet other embodiments, the audio device 104 may include more than two microphones, such as for example three, four, five, six, seven, eight, nine, ten or even more microphones.

The primary microphone 106 and secondary microphone 108 may be omni-directional microphones. Alternatively embodiments may utilize other forms of microphones or acoustic sensors.

While the microphones 106 and 108 receive sound (i.e. acoustic signals) from the audio source 102, the microphones 106 and 108 also pick up noise 110. Although the noise 110 is shown coming from a single location in FIG. 1, the noise 110 may include any sounds from one or more locations that differ from the location of audio source 102, and may include reverberations and echoes. The noise 110 may be stationary, non-stationary, and/or a combination of both stationary and non-stationary noise.

Some embodiments may utilize level differences (e.g. energy differences) between the acoustic signals received by the two microphones 106 and 108. Because the primary microphone 106 is much closer to the audio source 102 than the secondary microphone 108, the intensity level is higher for the primary microphone 106, resulting in a larger energy level received by the primary microphone 106 during a speech/voice segment, for example.

The level difference may then be used to discriminate speech and noise in the time-frequency domain. Further embodiments may use a combination of energy level differences and time delays to discriminate speech. Based on binaural cue encoding, speech signal extraction or speech enhancement may be performed.

Figure 2:
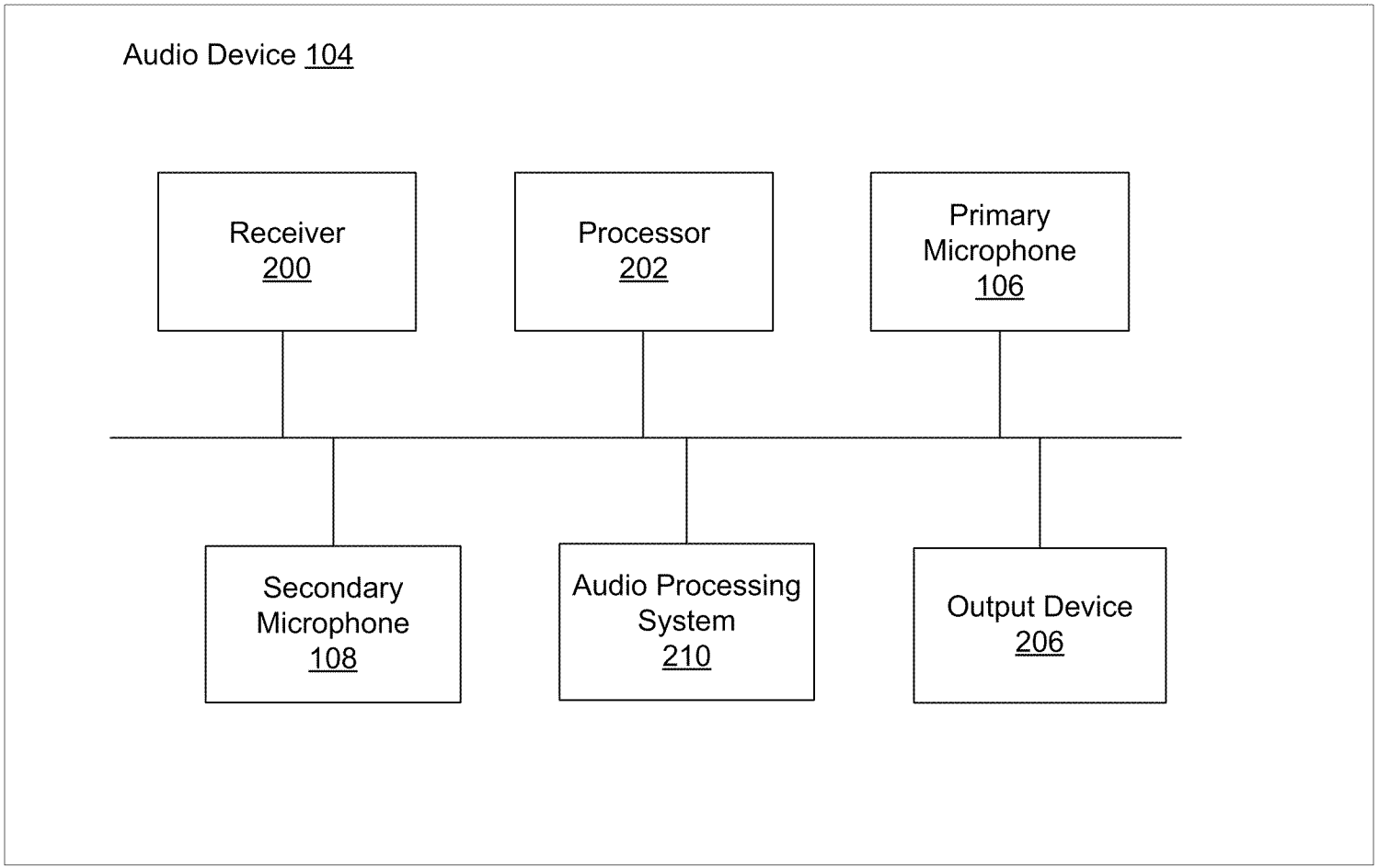
FIG. 2 is a block diagram of an exemplary audio device.

FIG. 2 is a block diagram of an exemplary audio device 104. In the illustrated embodiment, the audio device 104 includes a receiver 200, a processor 202, the primary microphone 106, an optional secondary microphone 108, an audio processing system 210, and an output device 206. The audio device 104 may include further or other components necessary for audio device 104 operations. Similarly, the audio device 104 may include fewer components that perform similar or equivalent functions to those depicted in FIG. 2.

Processor 202 may execute instructions and modules stored in a memory (not illustrated in FIG. 2) in the audio device 104 to perform functionality described herein, including noise suppression for an acoustic signal. Processor 202 may include hardware and software implemented as a processing unit, which may process floating point operations and other operations for the processor 202.

The exemplary receiver 200 is an acoustic sensor configured to receive a signal from a communications network. In some embodiments, the receiver 200 may include an antenna device. The signal may then be forwarded to the audio processing system 210 to reduce noise using the techniques described herein, and provide an audio signal to the output device 206. The present technology may be used in one or both of the transmit and receive paths of the audio device 104.

The audio processing system 210 is configured to receive the acoustic signals from an acoustic source via the primary microphone 106 and secondary microphone 108 and process the acoustic signals. Processing may include performing noise reduction within an acoustic signal. The audio processing system 210 is discussed in more detail below. The primary and secondary microphones 106, 108 may be spaced a distance apart in order to allow for detection of an energy level difference between them. The acoustic signals received by primary microphone 106 and secondary microphone 108 may be converted into electrical signals (i.e. a primary electrical signal and a secondary electrical signal). The electrical signals may themselves be converted by an analog-to-digital converter (not shown) into digital signals for processing in accordance with some embodiments. In order to differentiate the acoustic signals for clarity purposes, the acoustic signal received by the primary microphone 106 is herein referred to as the primary acoustic signal, while the acoustic signal received from by the secondary microphone 108 is herein referred to as the secondary acoustic signal. The primary acoustic signal and the secondary acoustic signal may be processed by the audio processing system 210 to produce a signal with an improved signal-to-noise ratio. It should be noted that embodiments of the technology described herein may be practiced utilizing only the primary microphone 106.

The output device 206 is any device which provides an audio output to the user. For example, the output device 206 may include a speaker, an earpiece of a headset or handset, or a speaker on a conference device.

In various embodiments, where the primary and secondary microphones are omni-directional microphones that are closely-spaced (e.g., 1-2 cm apart), a beamforming technique may be used to simulate forwards-facing and backwards-facing directional microphones. The level difference may be used to discriminate speech and noise in the time-frequency domain which can be used in noise reduction.

Figure 3:
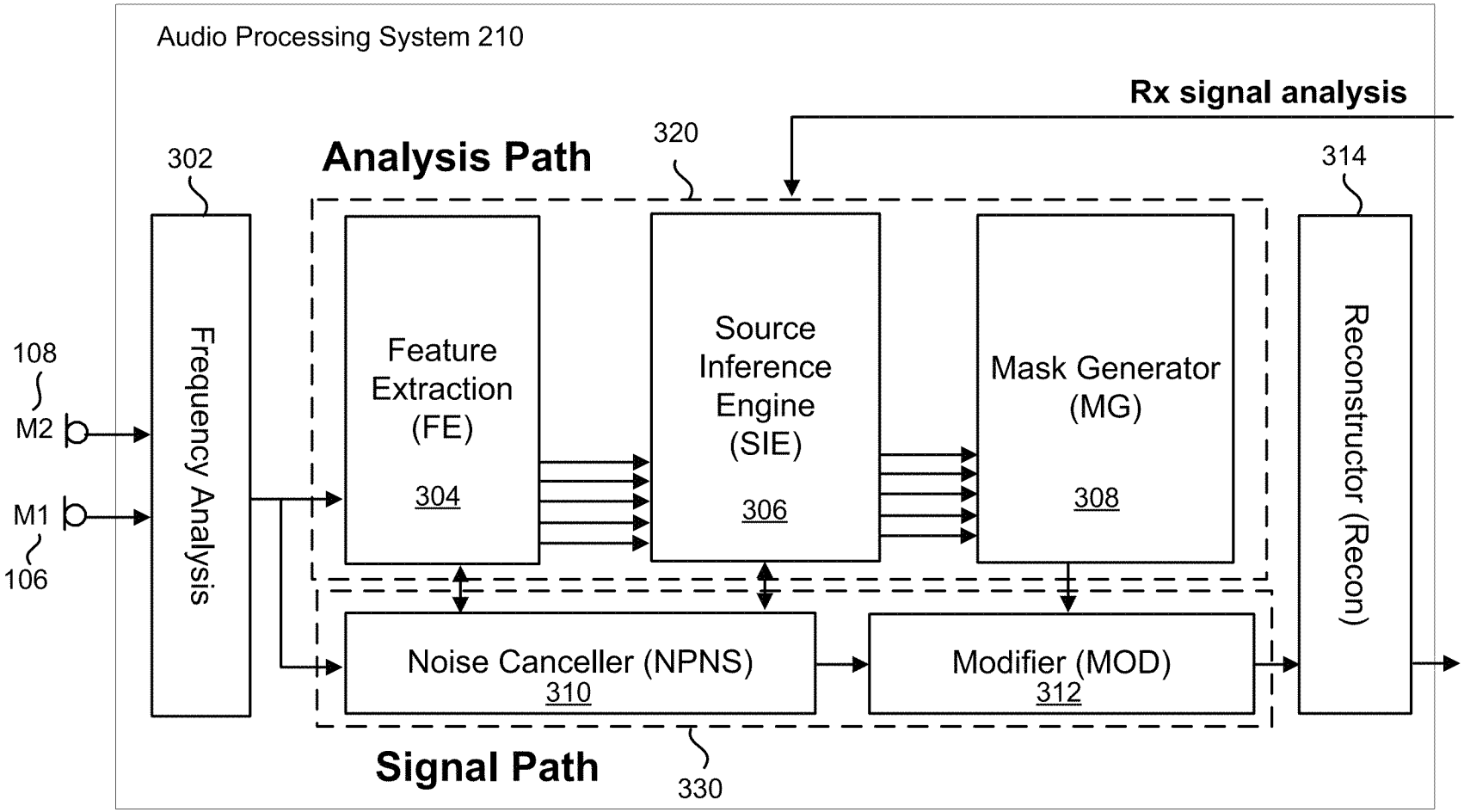
FIG. 3 is a block diagram of an exemplary audio processing system.

FIG. 3 is a block diagram of an exemplary audio processing system 210 for performing noise reduction as described herein. In exemplary embodiments, the audio processing system 210 is embodied within a memory device within audio device 104. The audio processing system 210 may include a frequency analysis module 302, a feature extraction module 304, a source inference engine module 306, mask generator module 308, noise canceller (NPNS) module 310, modifier module 312, and reconstructor module 314. The mask generator module 308 in conjunction with the modifier module 312 and the noise canceller module 310 is also referred to herein as a noise reduction module or NPNS module. Audio processing system 210 may include more or fewer components than illustrated in FIG. 3, and the functionality of modules may be combined or expanded into fewer or additional modules. Exemplary lines of communication are illustrated between various modules of FIG. 3, and in other figures herein. The lines of communication are not intended to limit which modules are communicatively coupled with others, nor are they intended to limit the number of and type of signals communicated between modules.

In operation, acoustic signals received from the primary microphone 106 and second microphone 108 are converted to electrical signals, and the electrical signals are processed through frequency analysis module 302. In one embodiment, the frequency analysis module 302 takes the acoustic signals and mimics the frequency analysis of the cochlea (e.g., cochlear domain), simulated by a filter bank. The frequency analysis module 302 separates each of the primary and secondary acoustic signals into two or more frequency sub-band signals. A sub-band signal is the result of a filtering operation on an input signal, where the bandwidth of the filter is narrower than the bandwidth of the signal received by the frequency analysis module 302. Alternatively, other filters such as short-time Fourier transform (STFT), sub-band filter banks, modulated complex lapped transforms, cochlear models, wavelets, etc., can be used for the frequency analysis and synthesis. Because most sounds (e.g. acoustic signals) are complex and include more than one frequency, a sub-band analysis on the acoustic signal determines what individual frequencies are present in each sub-band of the complex acoustic signal during a frame (e.g. a predetermined period of time). For example, the length of a frame may be 4 ms, 8 ms, or some other length of time. In some embodiments there may be no frame at all. The results may include sub-band signals in a fast cochlea transform (FCT) domain.

The sub-band frame signals are provided from frequency analysis module 302 to an analysis path sub-system 320 and to a signal path sub-system 330. The analysis path sub-system 320 may process the signal to identify signal features, distinguish between speech components and noise components of the sub-band signals, and generate a signal modifier. The signal path sub-system 330 is responsible for modifying sub-band signals of the primary acoustic signal by applying a noise canceller or a modifier, such as a multiplicative gain mask generated in the analysis path sub-system 320. The modification may reduce noise and to preserve the desired speech components in the sub-band signals.

Signal path sub-system 330 includes NPNS module 310 and modifier module 312. NPNS module 310 receives sub-band frame signals from frequency analysis module 302. NPNS module 310 may subtract (i.e., cancel) noise component from one or more sub-band signals of the primary acoustic signal. As such, NPNS module 310 may output sub-band estimates of noise components in the primary signal and sub-band estimates of speech components in the form of noise-subtracted sub-band signals.

NPNS module 310 may be implemented in a variety of ways. In some embodiments, NPNS module 310 may be implemented with a single NPNS module. Alternatively, NPNS module 310 may include two or more NPNS modules, which may be arranged for example in a cascaded fashion.

NPNS module 310 can provide noise cancellation for two-microphone configurations, for example based on source location, by utilizing a subtractive algorithm. It can also be used to provide echo cancellation. Since noise and echo cancellation can usually be achieved with little or no voice quality degradation, processing performed by NPNS module 310 may result in an increased SNR in the primary acoustic signal received by subsequent post-filtering and multiplicative stages. The amount of noise cancellation performed may depend on the diffuseness of the noise source and the distance between microphones. These both contribute towards the coherence of the noise between the microphones, with greater coherence resulting in better cancellation.

An example of noise cancellation performed in some embodiments by the noise canceller module 310 is disclosed in U.S. patent application Ser. No. 12/215,980, filed Jun. 30, 2008, U.S. application Ser. No. 12/422,917, filed Apr. 13, 2009, and U.S. application Ser. No. 12/693,998, filed Jan. 26, 2010, the disclosures of which are each incorporated herein by reference.

The feature extraction module 304 of the analysis path sub-system 320 receives the sub-band frame signals derived from the primary and secondary acoustic signals provided by frequency analysis module 302. Feature extraction module 304 receives the output of NPNS module 310 and computes frame energy estimations of the sub-band signals, inter-microphone level difference (ILD) between the primary acoustic signal and the secondary acoustic signal, self-noise estimates for the primary and second microphones. Feature extraction module 304 may also compute other monaural or binaural features which may be required by other modules, such as pitch estimates and cross-correlations between microphone signals. The feature extraction module 304 may both provide inputs to and process outputs from NPNS module 310.

Feature extraction module 304 may compute energy levels for the sub-band signals of the primary and secondary acoustic signal and an inter-microphone level difference (ILD) from the energy levels. The ILD may be determined by an ILD module within feature extraction module 304.

Determining energy level estimates and inter-microphone level differences is discussed in more detail in U.S. patent application Ser. No. 11/343,524, filed Jan. 30, 2006, which is incorporated by reference herein.

Source inference engine module 306 may process the frame energy estimations to compute noise estimates and may derive models of the noise and speech in the sub-band signals. Source inference engine module 306 adaptively estimates attributes of the acoustic sources, such as their energy spectra of the output signal of the NPNS module 310. The energy spectra attribute may be used to generate a multiplicative mask in mask generator module 308.

The source inference engine module 306 may receive the ILD from the feature extraction module 304 and track the ILD probability distributions or "clusters" of the target audio source 102, background noise and optionally echo. When ignoring echo, without any loss of generality, when the source and noise ILD distributions are non-overlapping, it is possible to specify a classification boundary or dominance threshold between the two distributions. The classification boundary or dominance threshold is used to classify the signal as speech if the SNR is sufficiently positive or as noise if the SNR is sufficiently negative. This classification may be determined per sub-band and time-frame as a dominance mask, and output by a cluster tracker module to a noise estimator module within the source inference engine module 306.

The cluster tracker module may generate a noise/speech classification signal per sub-band and provide the classification to NPNS module 310. In some embodiments, the classification is a control signal indicating the differentiation between noise and speech. NPNS module 310 may utilize the classification signals to estimate noise in received microphone energy estimate signals. In some embodiments, the results of cluster tracker module may be forwarded to the noise estimate module within the source inference engine module 306. In other words, a current noise estimate along with locations in the energy spectrum where the noise may be located are provided for processing a noise signal within audio processing system 210.

An example of tracking clusters by a cluster tracker module is disclosed in U.S. patent application Ser. No. 12/004,897, filed on Dec. 21, 2007, the disclosure of which is incorporated herein by reference.

Source inference engine module 306 may include a noise estimate module which may receive a noise/speech classification control signal from the cluster tracker module and the output of NPNS module 310 to estimate the noise N(t,w). The noise estimate determined by noise estimate module is provided to mask generator module 308. In some embodiments, mask generator module 308 receives the noise estimate output of NPNS module 310 and an output of the cluster tracker module.

The noise estimate module in the source inference engine module 306 may include an ILD noise estimator, and a stationary noise estimator. In one embodiment, the noise estimates are combined with a max( ) operation, so that the noise suppression performance resulting from the combined noise estimate is at least that of the individual noise estimates. The ILD noise estimate is derived from the dominance mask and NPNS module 310 output signal energy.

The mask generator module 308 receives models of the sub-band speech components and noise components as estimated by the source inference engine module 306. Noise estimates of the noise spectrum for each sub-band signal may be subtracted out of the energy estimate of the primary spectrum to infer a speech spectrum. Mask generator module 308 may determine a gain mask for the sub-band signals of the primary acoustic signal and provide the gain mask to modifier module 312. The modifier module 312 multiplies the gain masks to the noise-subtracted sub-band signals of the primary acoustic signal output by the NPNS module 310. Applying the mask reduces energy levels of noise components in the sub-band signals of the primary acoustic signal and performs noise reduction.

As described in more detail below, the values of the gain mask output from mask generator module 308 are time and sub-band signal dependent and optimize noise reduction on a per sub-band basis. The noise reduction may be subject to the constraint that the speech loss distortion complies with a tolerable threshold limit. The threshold limit may be based on many factors, such as for example a voice quality optimized suppression (VQOS) level. The VQOS level is an estimated maximum threshold level of speech loss distortion in the sub-band signal introduced by the noise reduction. The VQOS is tunable and takes into account the properties of the sub-band signal, thereby providing full design flexibility for system and acoustic designers. A lower bound for the amount of noise reduction performed in a sub-band signal is determined subject to the VQOS threshold, thereby limiting the amount of speech loss distortion of the sub-band signal. As a result, a large amount of noise reduction may be performed in a sub-band signal when possible. The noise reduction may be smaller when conditions such as unacceptably high speech loss distortion do not allow for the large amount of noise reduction.

In embodiments, the energy level of the noise component in the sub-band signal may be reduced to no less than a residual noise target level. The residual noise target level may be fixed or slowly time-varying. In some embodiments, the residual noise target level is the same for each sub-band signal. Such a target level may for example be a level at which the noise component ceases to be audible or perceptible, or below a self-noise level of a microphone used to capture the primary acoustic signal. As another example, the residual noise target level may be below a noise gate of a component such as an internal AGC noise gate or baseband noise gate within a system implementing the noise reduction techniques described herein.

Reconstructor module 314 may convert the masked frequency sub-band signals from the cochlea domain back into the time domain. The conversion may include adding the masked frequency sub-band signals and phase shifted signals. Alternatively, the conversion may include multiplying the masked frequency sub-band signals with an inverse frequency of the cochlea channels. Once conversion to the time domain is completed, the synthesized acoustic signal may be output to the user via output device 206 and/or provided to a codec for encoding.

In some embodiments, additional post-processing of the synthesized time domain acoustic signal may be performed. For example, comfort noise generated by a comfort noise generator may be added to the synthesized acoustic signal prior to providing the signal to the user. Comfort noise may be a uniform constant noise that is not usually discernible to a listener (e.g., pink noise). This comfort noise may be added to the synthesized acoustic signal to enforce a threshold of audibility and to mask low-level non-stationary output noise components. In some embodiments, the comfort noise level may be chosen to be just above a threshold of audibility and may be settable by a user. In some embodiments, the mask generator module 308 may have access to the level of comfort noise in order to generate gain masks that will suppress the noise to a level at or below the comfort noise.

The system of FIG. 3 may process several types of signals processed by an audio device. The system may be applied to acoustic signals received via one or more microphones. The system may also process signals, such as a digital Rx signal, received through an antenna or other connection.

Figure 4:
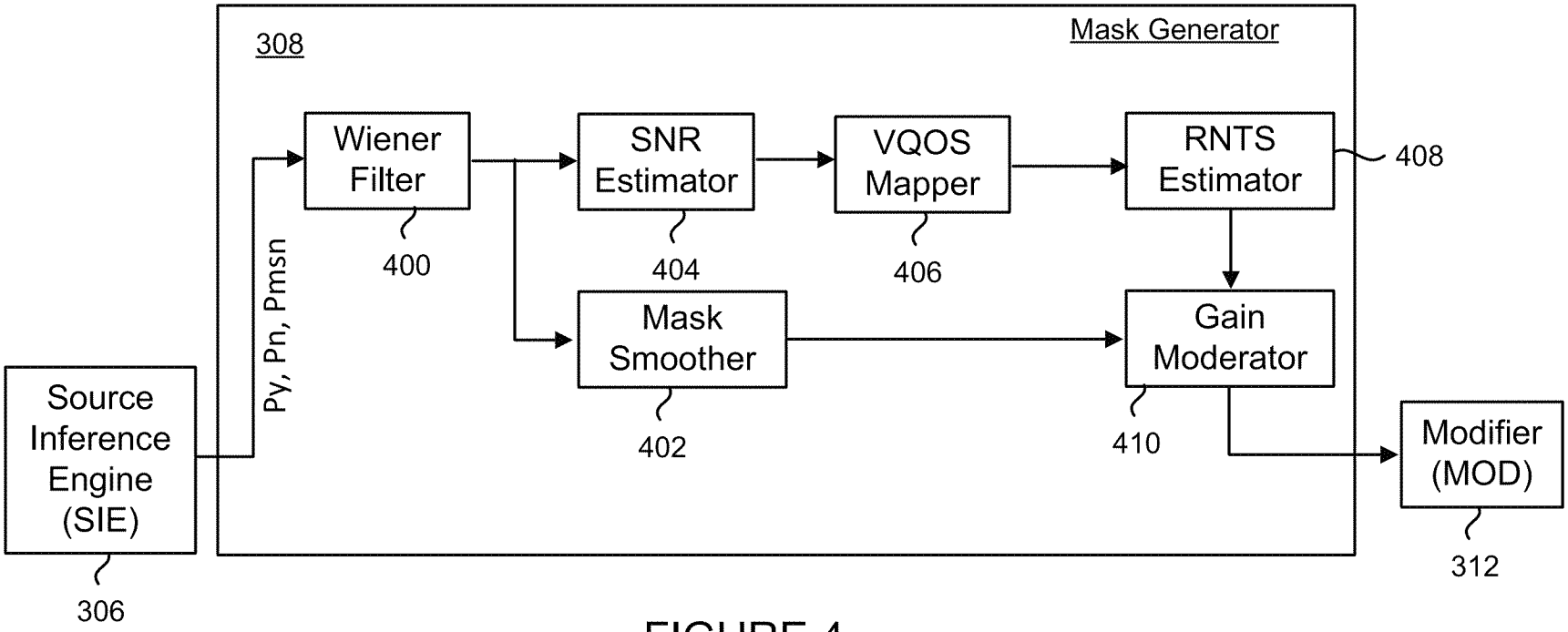
FIG. 4 is a block diagram of an exemplary mask generator module.

FIG. 4 is an exemplary block diagram of the mask generator module 308. The mask generator module 308 may include a Wiener filter module 400, mask smoother module 402, signal-to-noise (SNR) ratio estimator module 404, VQOS mapper module 406, residual noise target suppressor (RNTS) estimator module 408, and a gain moderator module 410. Mask generator module 308 may include more or fewer components than those illustrated in FIG. 4, and the functionality of modules may be combined or expanded into fewer or additional modules.

The Wiener filter module 400 calculates Wiener filter gain mask values, $G_{wf}(t,\omega)$, for each sub-band signal of the primary acoustic signal. The gain mask values may be based on the noise and speech short-term power spectral densities during time frame t and sub-band signal index w. This can be represented mathematically as:

$$G_{wf}(t,\omega)=\frac{P_s(t,\omega)}{P_s(t,\omega)+P_n(t,\omega)}$$

$P_s$ is the estimated power spectral density of speech in the sub-band signal ω of the primary acoustic signal during time frame t. $P_n$ is the estimated power spectral density of the noise in the sub-band signal ω of the primary acoustic signal during time frame t. As described above, $P_n$ may be calculated by source inference engine module 306. $P_s$ may be computed mathematically as:

$$P_s(t,\omega)=\hat{P}_s(t-1,\omega)+\lambda_s\cdot(P_y(t,\omega)-P_n(t,\omega)-\hat{P}_s(t-1,\omega))$$

$$\hat{P}_s(t,\omega)=P_y(t,\omega)\cdot(G_{wf}(t,\omega))^2$$

$\lambda_s$ is the forgetting factor of a 1st order recursive IIR filter or leaky integrator, $P_y$ is the power spectral density of the primary acoustic signal output by the NPNS module 310 as described above. The Wiener filter gain mask values, $G_{wf}(t,\omega)$, derived from the speech and noise estimates may not be optimal from a perceptual sense. That is, the Wiener filter may typically be configured to minimize certain mathematical error quantities, without taking into account a user's perception of any resulting speech distortion. As a result, a certain amount of speech distortion may be introduced as a side effect of noise suppression using the Wiener filter gain mask values. For example, speech components that are lower in energy than the noise typically end up being suppressed by the noise suppressor, which results in a modification of the output speech spectrum that is perceived as speech distortion. This speech degradation will become more severe as the noise level rises and more speech components are attenuated by the noise suppressor. That is, as the SNR gets lower, typically more speech components are buried in noise or interpreted as noise, and thus there is more resulting speech loss distortion. In some embodiments, spectral subtraction or Ephraim-Malah formula, or other mechanisms for determining an initial gain value based on the speech and noise PSD may be utilized.

To limit the amount of speech distortion as a result of the mask application, the Wiener gain values may be lower bounded using a perceptually-derived gain lower bound, $G_{lb}(t,\omega)$:

$$G_n(t,\omega)=\max(G_{wf}(t,\omega),G_{lb}(t,\omega))$$

where $G_n(t,\omega)$ is the noise suppression mask, and $G_{lb}(t,\omega)$ is a complex function of the instantaneous SNR in that sub-band signal, frequency, power and VQOS level. The gain lower bound is derived utilizing both the VQOS mapper module 406 and the RNTS estimator module 408 as discussed below.

Wiener filter module 400 may also include a global voice activity detector (VAD), and a sub-band VAD for each sub-band or "VAD mask". The global VAD and sub-band VAD mask can be used by mask generator module 308, e.g. within the mask smoother module 402, and outside of the mask generator module 308, e.g. an Automatic Gain Control (AGC). The sub-band VAD mask and global VAD are derived directly from the Wiener gain:

$$M_{vad}(t,\omega)=G_{wf}(t,\omega)>g_1$$

$$n(t)=\sum_{\omega}M_{vad}(t,\omega)$$

$$VAD(t)=(n(t)>n_1)-(n(t)<n_2)$$

where $g_1$ is a gain threshold, $n_1$ and $n_2$ are thresholds on the number of sub-bands where the VAD mask must indicate active speech, and $n_1>n_2$. Thus, the VAD is 3-way wherein VAD(t)=1 indicates a speech frame, VAD(t)=−1 indicates a noise frame, and VAD(t)=0 is not definitively either a speech frame or a noise frame. Since the VAD and VAD mask are derived from the Wiener filter gain, they are independent of the gain lower bound and VQOS level. This is advantageous, for example, in obtaining similar AGC behavior even as the amount of noise suppression varies.

The SNR estimator module 404 receives energy estimations of a noise component and speech component in a particular sub-band and calculates the SNR per sub-band signal of the primary acoustic signal. The calculated per sub-band SNR is provided to and used by VQOS mapper module 406 and RNTS estimator module 408 to compute the perceptually-derived gain lower bound as described below.

In the illustrated embodiment the SNR estimator module 404 calculates instantaneous SNR as the ratio of long-term peak speech energy, $\tilde{P}_s(t,\omega)$, to the instantaneous noise energy, $\hat{P}_n(t,\omega)$:

$$SNR(t,\omega)\propto\frac{\tilde{P}_s(t,\omega)}{\hat{P}_n(t,\omega)}$$

$\tilde{P}_s(t,\omega)$ can be determined using one or more of mechanisms based upon the input instantaneous speech power estimate and noise power estimate $P_n(t,\omega)$. The mechanisms may include a peak speech level tracker, average speech energy in the highest x dB of the speech signal's dynamic range, reset the speech level tracker after sudden drop in speech level, e.g. after shouting, apply lower bound to speech estimate at low frequencies (which may be below the fundamental component of the talker), smooth speech power and noise power across sub-bands, and add fixed biases to the speech power estimates and SNR so that they match the correct values for a set of oracle mixtures.

The SNR estimator module 404 can also calculate a global SNR (across all sub-band signals). This may be useful in other modules within the system 210, or may be configured as an output API of the OS for controlling other functions of the audio device 104.

The VQOS mapper module 406 determines the minimum gain lower bound for each sub-band signal, $\hat{G}_{lb}(t,\omega)$. The minimum gain lower bound is subject to the constraint that the introduced perceptual speech loss distortion should be no more than a tolerable threshold level as determined by the specified VQOS level. The maximum suppression value (inverse of $\hat{G}_{lb}(t, \omega)$, varies across the sub-band signals and is determined based on the frequency and SNR of each sub-band signal, and the VQOS level.

The minimum gain lower bound for each sub-band signal can be represented mathematically as:

$$\hat{G}_{lb}(t,\omega)=f(VQOS,\omega,SNR(t,\omega))$$

The VQOS level defines the maximum tolerable speech loss distortion. The VQOS level can be selectable or tunable from among a number of threshold levels of speech distortion. As such, the VQOS level takes into account the properties of the primary acoustic signal and provides full design flexibility for systems and acoustic designers.

In the illustrated embodiment, the minimum gain lower bound for each sub-band signal, $\hat{G}_{lb}(t,\omega)$, is determined using look-up tables stored in memory in the audio device 104.

The look-up tables can be generated empirically using subjective speech quality assessment tests. For example, listeners can rate the level of speech loss distortion (VQOS level) of audio signals for various suppression levels and signal-to-noise ratios. These ratings can then be used to generate the look-up tables as a subjective measure of audio signal quality. Alternative techniques, such as the use of objective measures for estimating audio signal quality using computerized techniques, may also be used to generate the look-up tables in some embodiments.

In one embodiment, the levels of speech loss distortion may be defined as:

| VQOS Level | Speech-Loss Distortion (SLD) |
|---|---|
| 0 | No speech distortion |
| 2 | No perceptible speech distortion |
| 4 | Barely perceptible speech distortion |
| 6 | Perceptible but not excessive speech distortion |
| 8 | Slightly excessive speech distortion |
| 10 | Excessive speech distortion |

In this example, VQOS level 0 corresponds to zero suppression, so it is effectively a bypass of the noise suppressor. The look-up tables for VQOS levels between the above identified levels, such as VQOS level 5 between VQOS levels 4 and 6, can be determined by interpolation between the levels. The levels of speech distortion may also extend beyond excessive speech distortion. Since VQOS level 10 represents excessive speech distortion in the above example, each level higher than 10 may be represented as a fixed number of dB extra noise suppression, such as 3 dB.

Figure 5:
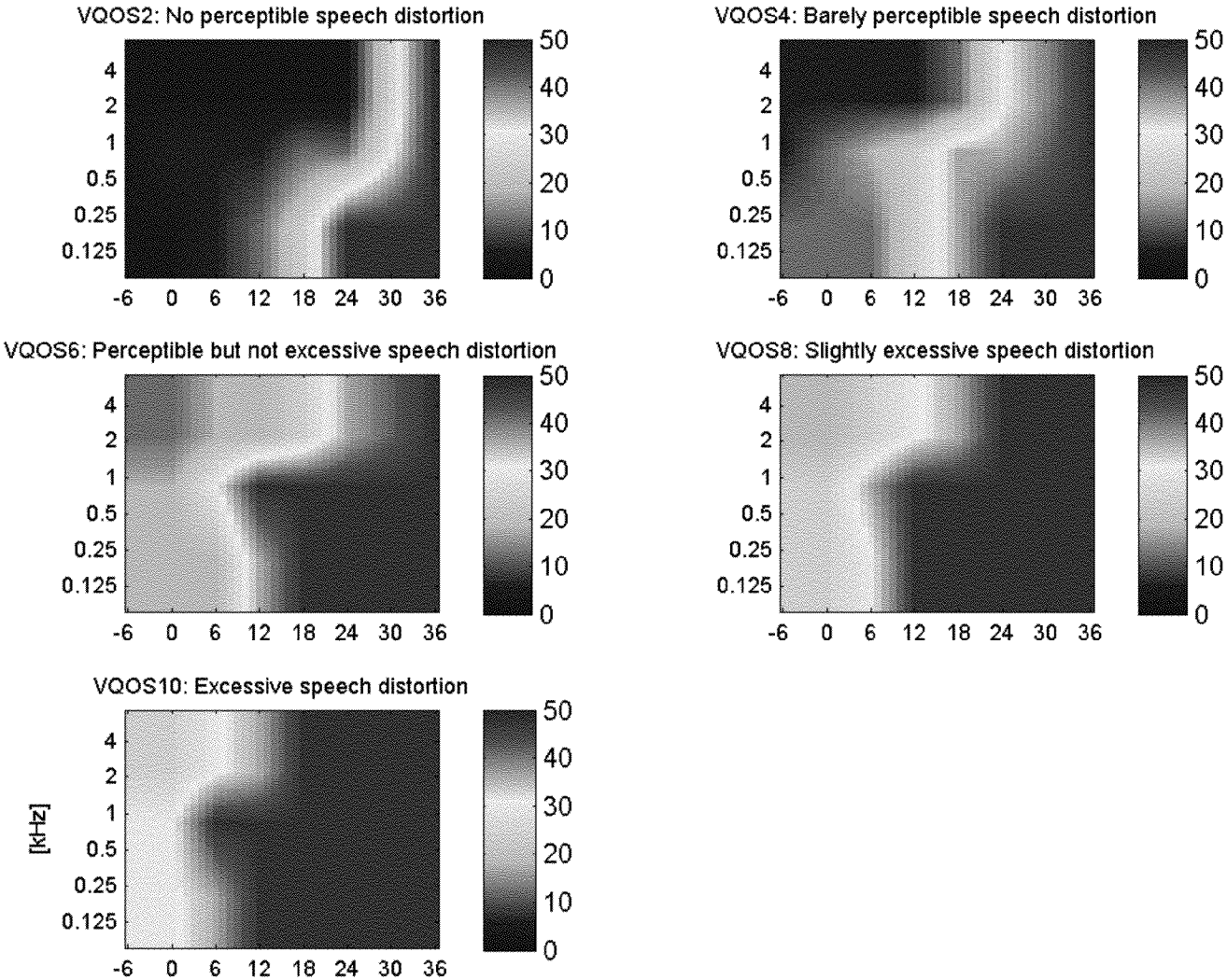
FIG. 5 is an illustration of exemplary look-up tables for maximum suppression values.

FIG. 5 is an illustration of exemplary look-up tables for maximum suppression values (inverse of minimum $\hat{G}_{lb}(t,\omega)$) for VQOS levels of 2, 4, 6, 8 and 10 as a function of signal-to-noise ratio and center frequency of the sub-band signals. The tables indicate the maximum achievable suppression value before a certain level of speech distortion is obtained, as indicated by the title of each table illustrated in FIG. 5. For example, for a signal-to-noise ratio of 18 dB, a sub-band center frequency of 0.5 kHz, and VQOS level 2, the maximum achievable suppression value is about 18 dB. As the suppression value is increased above 18 dB, the speech distortion is more than "No perceptible speech distortion." As described above, the values in the look-up tables can be determined empirically, and can vary from embodiment to embodiment.

The look-up tables in FIG. 5 illustrate three behaviors. First, the maximum suppression achievable is monotonically increasing with the VQOS level. Second, the maximum suppression achievable is monotonically increasing with the sub-band signal SNR. Third, a given amount of suppression results in more speech loss distortion at high frequencies than at low frequencies.

As such, the VQOS mapper module 406 is based on a perceptual model that maintains the speech loss distortion below some tolerable threshold level whilst at the same time maximizing the amount of suppression across SNRs and noise types. As a result, a large amount of noise suppression may be performed in a sub-band signal when possible. The noise suppression may be smaller when conditions such as unacceptably high speech loss distortion do not allow for the large amount of noise reduction.

Referring back to FIG. 4, the RNTS estimator module 408 determines the final gain lower bound, $G_{lb}(t,\omega)$. The minimum gain lower bound, $\hat{G}_{lb}(t,\omega)$, provided by the VQOS mapper module 406 is subject to the constraint that the energy level of the noise component in each sub-band signal is reduced to no less than a residual noise target level (RNTL). As described in more detail below, in some instances minimum gain lower bound provided by the VQOS mapper module 406 may be lower than necessary to render the residual noise below the RNTL. As a result, using the minimum gain lower bound provided by the VQOS mapper module 406 may result in more speech loss distortion than is necessary to achieve the objective that the residual noise is below the RNTL. In such a case, the RNTS estimator module 408 limits the minimum gain lower bound, thereby backing off on the suppression and the resulting speech loss distortion. For example, a first value for the gain lower bound may be determined based exclusively on the estimated SNR and the VQOS level. A second value for the gain lower bound may be determined based on reducing the energy level of the noise component in the sub-band signal to the RNTL. The final GLB, $G_{lb}(t,\omega)$, can then be determined by selecting the smaller of the two suppression values.

The final gain lower bound can be further limited so that the maximum suppression applied does not result in the noise being reduced if the energy level $P_n(t,\omega)$ of the noise component is below the energy level $P_{rntl}(t,\omega)$ of the RNTL. That is, if the energy level is already below the RNTL, the final gain lower bound is unity. In such a case, the final gain lower bound can be represented mathematically as:

$$G_{lb}(t, \omega) = \max\left(\min\left(1, \frac{P_{rntl}(t, \omega)}{P_n(t, \omega)}\right), \hat{G}_{lb}(t, \omega)\right)$$

At lower SNR, the residual noise may be audible, since the gain lower bound is generally lower bounded to avoid excessive speech loss distortion, as discussed above with respect to the VQOS mapper module 406. However, at higher SNRs the residual noise may be rendered completely inaudible; in fact the minimum gain lower bound provided by the VQOS mapper module 406 may be lower than necessary to render the noise inaudible. As a result, using the minimum gain lower bound provided by the VQOS mapper module 406 may result in more speech loss distortion than is necessary to achieve the objective that the residual noise is below the RNTL. In such a case, the RNTS estimator module 408 (also referred to herein as residual noise target suppressor estimator module) limits the minimum GLB, thereby backing off on the suppression.

The choice of RNTL depends on the objective of the system. The RNTL may be static or adaptive, frequency dependent or a scalar, or computed at calibration time or settable through optional device dependent parameters or application program interface (API). In some embodiments the RNTL is the same for each sub-band signal. The RNTL may for example be defined as a level at which the noise component ceases to be perceptible, or below a self-noise level energy estimate $P_{msn}$ of the primary microphone 106 used to capture the primary acoustic signal device. The self-noise level energy estimate can be pre-calibrated or derived by the feature extraction module 304. As another example, the RNTL may be below a noise gate of a component such as an internal AGC noise gate or baseband noise gate within a system used to perform the noise reduction techniques described herein.

Reducing the noise component to a residual noise target level provides several beneficial effects. First, the residual noise is "whitened", i.e. it has a smoother and more constant magnitude spectrum over time, so that is sounds less annoying and more like comfort noise. Second, when encoding with a codec that includes discontinuous transmission (DTX), the "whitening" effect results in less modulation over time being introduced. If the codec is receiving residual noise which is modulating a lot over time, the codec may incorrectly identify and encode some of the residual noise as speech, resulting in audible bursts of noise being injected into the noise reduced signal. The reduction in modulation over time also reduces the amount of MIPS needed to encode the signal, which saves power. The reduction in modulation over time further results in less bits per frame for the encoded signal, which also reduces the power needed to transmit the encoded signal and effectively increases network capacity used for a network carrying the encoded signal.

Figure 6:
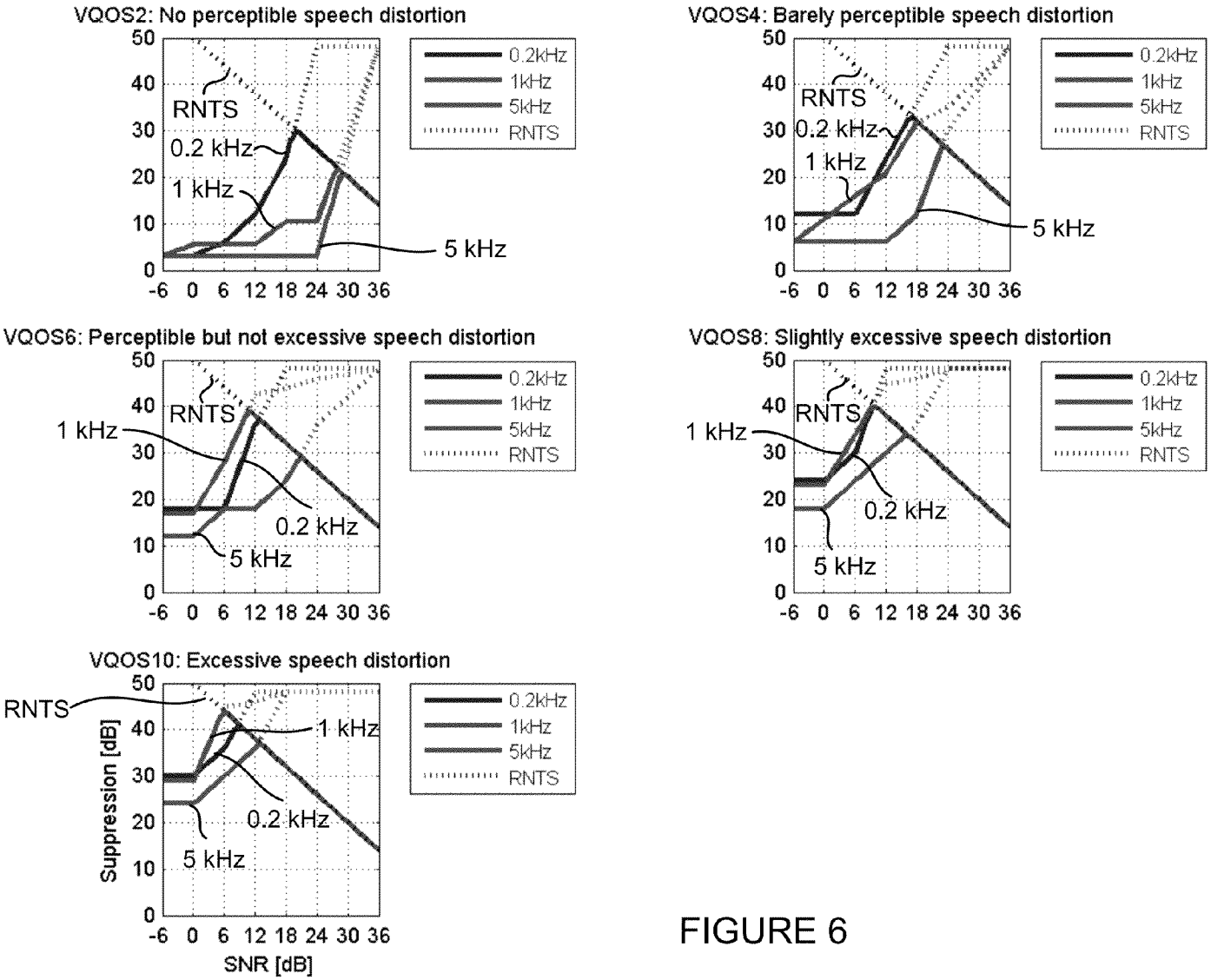
FIG. 6 illustrates exemplary suppression values for different levels of speech loss distortion.

FIG. 6 illustrates exemplary suppression values as a function of sub-band SNR for different VQOS levels. In FIG. 6, exemplary suppression values are illustrated for sub-band signals having center frequencies of 0.2 kHz, 1 kHz and 5 kHz respectively. The exemplary suppression values are the inverse of the final gain lower bound, $G_{lb}(t,\omega)$ as output from residual noise target suppressor estimator module 408. The sloped dashed lines labeled RNTS in each plot in FIG. 6 indicate the minimum suppression necessary to place the residual noise for each sub-band signal below a given residual noise target level. The residual noise target level in this particular example is spectrally flat.

The solid lines are the actual suppression values for each sub-band signal as determined by residual noise target suppressor estimator module 408. The dashed lines extending from the solid lines and above the lines labeled RNTS show the suppression values for each sub-band signal in the absence of the residual noise target level constraint imposed by RNTS estimator module 408. For example, without the residual noise target level constraint, the suppression value in the illustrated example would be about 48 dB for a VQOS level of 2, an SNR of 24 dB, and a sub-band center frequency of 0.2 kHz. In contrast, with the residual noise target level constraint, the final suppression value is about 26 dB.

As illustrated in FIG. 6, suppression at high SNR values is bounded by residual noise target level imposed by the RNTS estimator module 408. At moderate SNR values, relatively high suppression can be applied before reaching the acceptable speech loss distortion threshold level. At low SNRs the suppression is largely bounded by the speech loss distortion introduced by the noise reduction, so the suppression is relatively small.

Figure 7:
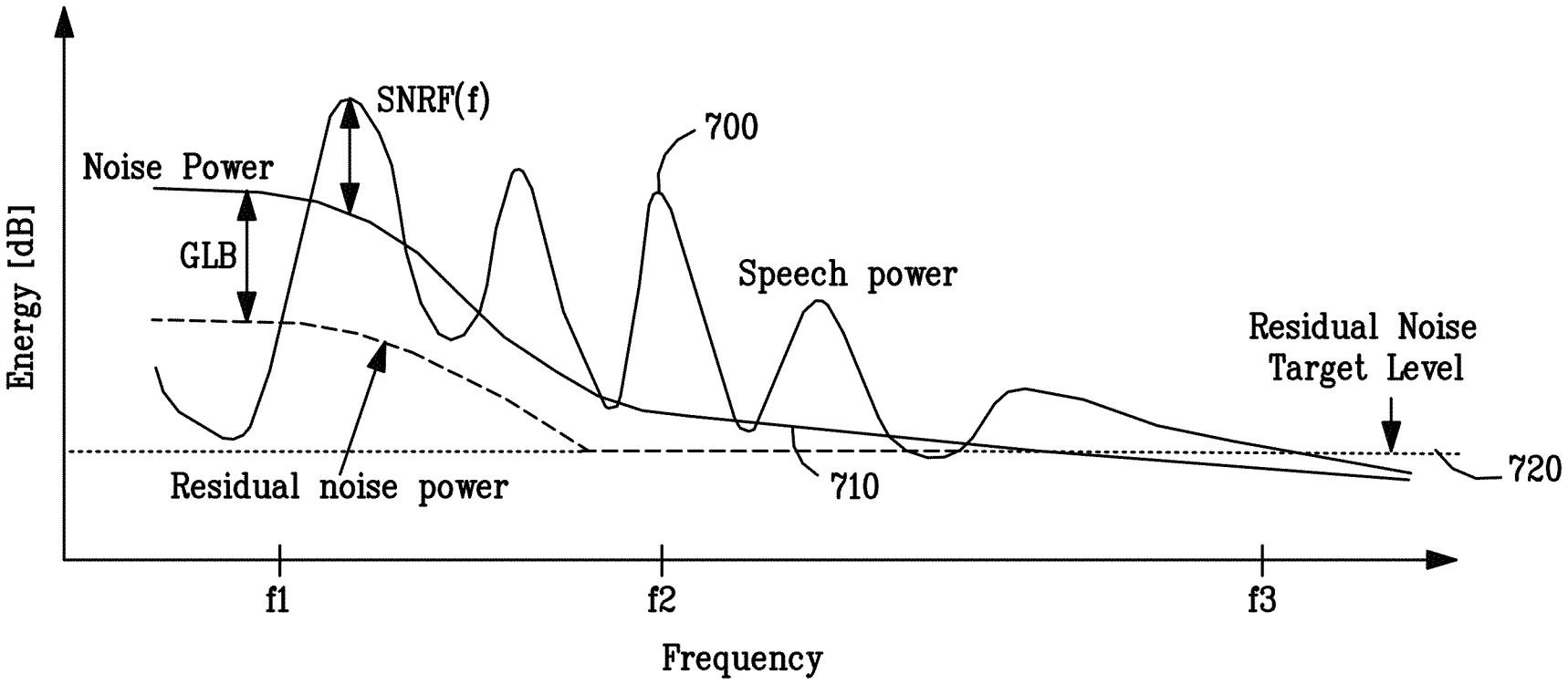
FIG. 7 is an illustration of the final gain lower bound across the sub-bands.

FIG. 7 is an illustration of the final gain lower bound, $G_{lb}(t,\omega)$ across the sub-bands, for an exemplary input speech power spectrum 700, noise power 710, and RNTL 720. In the illustrated example, the final gain lower bound at frequency f1 is limited to a suppression value less than that necessary to reduce the noise power 710 to the RNTL 720. As a result, the residual noise power at f1 is above the RNTL 720. The final gain lower bound at frequency f2 results in a suppression of the noise power 710 down to the RNTL 720, and thus is limited by the residual noise target suppressor estimator module 408 using the techniques described above. At frequency f3, the noise power 710 is less than the RNTL 720. Thus, at frequency f3, the final gain lower bound is unity so that no suppression is applied and the noise power 710 is not changed.

Referring back to FIG. 4, the Wiener gain values from the Wiener filter module 400 are also provided to the optional mask smoother module 402. The mask smoother module 402 performs temporal smoothing of the Wiener gain values, which helps to reduce the musical noise. The Wiener gain values may change quickly (e.g. from one frame to the next) and speech and noise estimates can vary greatly between each frame. Thus, the use of the Wiener gain values, as is, may result in artifacts (e.g. discontinuities, blips, transients, etc.). Therefore, optional filter smoothing may be performed in the mask smoother module 402 to temporally smooth the Wiener gain values.

The gain moderator module 410 then maintains a limit, or lower bounds, the smoothed Wiener gain values and the gain lower bound provided by the residual noise target suppressor estimator module 408. This is done to moderate the mask so that it does not severely distort speech. This can be represented mathematically as:

$$G_n(t,\omega)=\max(G_{wf}(t,\omega),G_{lb}(t,\omega))$$

The final gain lower bound for each sub-band signal is then provided from the gain moderator module 410 to the modifier module 312. As described above, the modifier module 312 multiplies the gain lower bounds with the noise-subtracted sub-band signals of the primary acoustic signal (output by the NPNS module 310). This multiplicative process reduces energy levels of noise components in the sub-band signals of the primary acoustic signal, thereby resulting in noise reduction.

Figure 8:
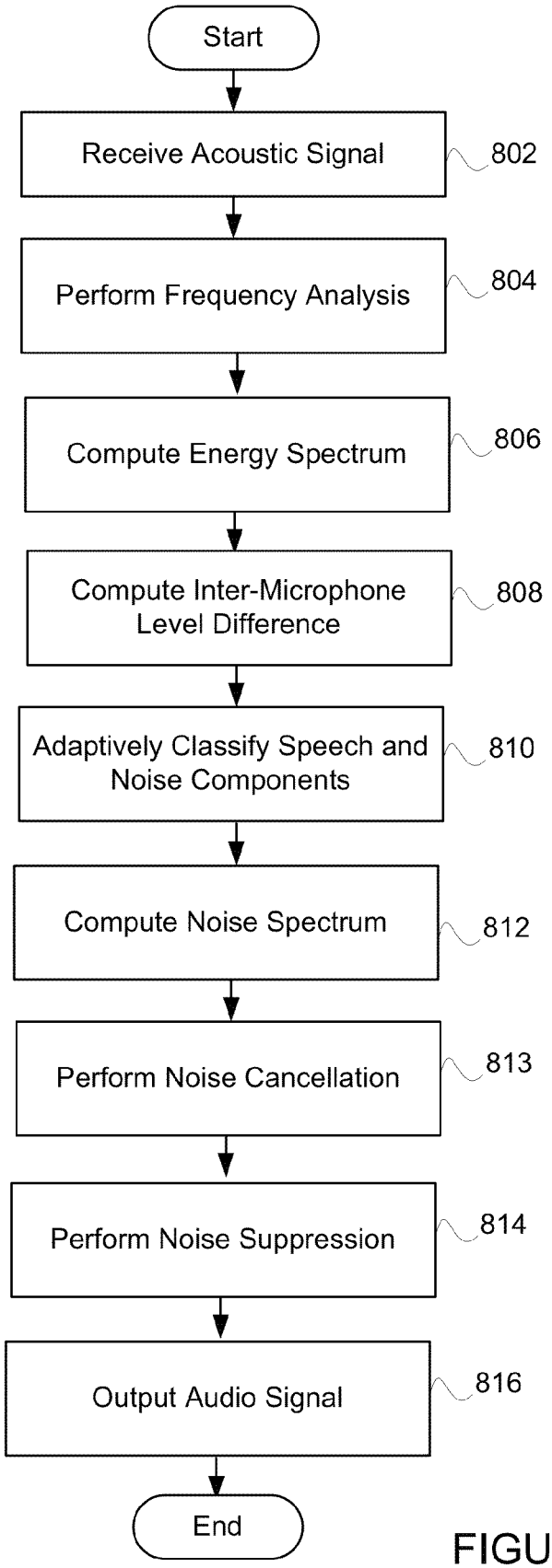
FIG. 8 is a flowchart of an exemplary method for performing noise reduction for an acoustic signal.

FIG. 8 is a flowchart of an exemplary method for performing noise reduction of an acoustic signal. Each step of FIG. 8 may be performed in any order, and the method of FIG. 8 may include additional or fewer steps than those illustrated.

In step 802, acoustic signals are received by the primary microphone 106 and a secondary microphone 108. In exemplary embodiments, the acoustic signals are converted to digital format for processing. In some embodiments, acoustic signals are received from more or fewer than two microphones.

Frequency analysis is then performed on the acoustic signals in step 804 to separate the acoustic signals into sub-band signals. The frequency analysis may utilize a filter bank, or for example a discrete Fourier transform or discrete cosine transform.

In step 806, energy spectrums for the sub-band signals of the acoustic signals received at both the primary and second microphones are computed. Once the energy estimates are calculated, inter-microphone level differences (ILD) are computed in step 808. In one embodiment, the ILD is calculated based on the energy estimates (i.e. the energy spectrum) of both the primary and secondary acoustic signals.

Speech and noise components are adaptively classified in step 810. Step 810 includes analyzing the received energy estimates and, if available, the ILD to distinguish speech from noise in an acoustic signal.

The noise spectrum of the sub-band signals is determined at step 812. In embodiments, noise estimate for each sub-band signal is based on the primary acoustic signal received at the primary microphone 106. The noise estimate may be based on the current energy estimate for the sub-band signal of the primary acoustic signal received from the primary microphone 106 and a previously computed noise estimate. In determining the noise estimate, the noise estimation may be frozen or slowed down when the ILD increases, according to exemplary embodiments.

In step 813, noise cancellation is performed. In step 814, noise suppression is performed. The noise suppression process is discussed in more detail below with respect to FIG. 9. The noise suppressed acoustic signal may then be output to the user in step 816. In some embodiments, the digital acoustic signal is converted to an analog signal for output. The output may be via a speaker, earpieces, or other similar devices, for example.

Figure 9:
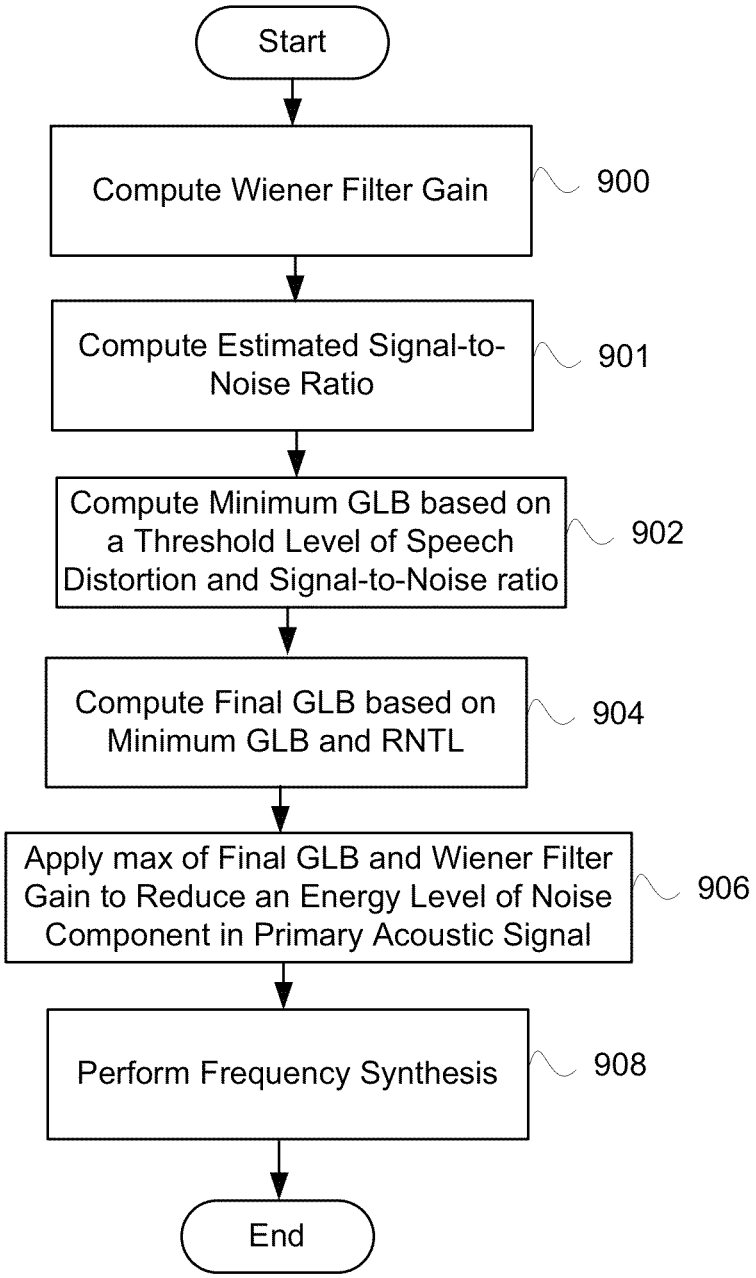
FIG. 9 is a flowchart of an exemplary method for performing noise suppression for an acoustic signal.

FIG. 9 is a flowchart of an exemplary method for performing noise suppression for an acoustic signal. Each step of FIG. 9 may be performed in any order, and the method of FIG. 9 may include additional or fewer steps than those illustrated.

The Wiener filter gain for each sub-band signal is computed at step 900. The estimated signal-to-noise ratio of each sub-band signal within the primary acoustic signal is computed at step 901. The SNR may be the instantaneous SNR, represented as the ratio of long-term peak speech energy to the instantaneous noise energy.

The minimum gain lower bound, $\hat{G}_{lb}(t,\omega)$, for each sub-band signal may be determined based on the estimated SNR for each sub-band signal at step 902. The minimum gain lower bound is determined such that the introduced perceptual speech loss distortion is no more than a tolerable threshold level. The tolerable threshold level may be determined by the specified VQOS level or based on some other criteria.

At step 904, the final gain lower bound is determined for each sub-band signal. The final gain lower bound may be determined by limiting the minimum gain lower bounds. The final gain lower bound is subject to the constraint that the energy level of the noise component in each sub-band signal is reduced to no less than a residual noise target level.

At step 906, the maximum of final gain lower bound and the Wiener filter gain for each sub-band signal is multiplied by the corresponding noise-subtracted sub-band signals of the primary acoustic signal output by the NPNS module 310. The multiplication reduces the level of noise in the noise-subtracted sub-band signals, resulting in noise reduction.

At step 908, the masked sub-band signals of the primary acoustic signal are converted back into the time domain. Exemplary conversion techniques apply an inverse frequency of the cochlea channel to the masked sub-band signals in order to synthesize the masked sub-band signals. In step 908, additional post-processing may also be performed, such as applying comfort noise. In various embodiments, the comfort noise is applied via an adder.

Noise reduction techniques described herein implement the reduction values as gain masks which are multiplied to the sub-band signals to suppress the energy levels of noise components in the sub-band signals. This process is referred to as multiplicative noise suppression. In embodiments, the noise reduction techniques described herein can also or alternatively be utilized in subtractive noise cancellation process. In such a case, the reduction values can be derived to provide a lower bound for the amount of noise cancellation performed in a sub-band signal, for example by controlling the value of the cross-fade between an optionally noise cancelled sub-band signal and the original noisy primary sub-band signals. This subtractive noise cancellation process can be carried out for example in NPNS module 310.

The above described modules, including those discussed with respect to FIGS. 3 and 4, may be included as instructions that are stored in a storage media such as a machine readable medium (e.g., computer readable medium). These instructions may be retrieved and executed by the processor 202 to perform the functionality discussed herein. Some examples of instructions include software, program code, and firmware. Some examples of storage media include memory devices and integrated circuits.

While the present invention is disclosed by reference to the preferred embodiments and examples detailed above, it is to be understood that these examples are intended in an illustrative rather than a limiting sense. It is contemplated that modifications and combinations will readily occur to those skilled in the art, which modifications and combinations will be within the spirit of the invention and the scope of the following claims.

What is claimed is:

1. A method for reducing noise within an acoustic signal, comprising:

separating, via at least one computer processor, an acoustic signal into a plurality of sub-band signals, the acoustic signal representing at least one captured sound; and reducing an energy level of a noise component in a sub-band signal in the plurality of sub-band signals, the reducing based on:

(i) an estimated signal-to-noise ratio of the sub-band signal, and (ii) an estimated threshold level of speech loss distortion in the sub-band signal.

2. The method of claim 1, wherein the amount of noise reduction is reduced when speech loss distortion above a threshold would otherwise result if the amount of noise reduction was increased or maintained, the speech loss distortion being excessive when above the threshold.

3. The method of claim 2, wherein the speech loss distortion, that is limited by the method, arises when speech components, that are lower in energy level than the noise, are suppressed during noise reduction.

4. The method of claim 1, wherein the reducing an energy level of a noise component in a sub-band signal in the plurality of sub-band signals comprises applying a reduction value to the sub-band signal.

5. The method of claim 4, wherein applying the reduction value comprises performing noise cancellation of the sub-band signal based on the reduction value.

6. The method of claim 5, further comprising multiplying another reduction value to the sub-band signal to further reduce the energy level of the noise component.

7. The method of claim 4, wherein applying the reduction value comprises multiplying the reduction value to the sub-band signal.

8. The method of claim 4, wherein the energy level of the noise component in the sub-band signal is reduced to no less than a residual noise target level.

9. The method of claim 8, further comprising:

determining a first value for the reduction value based on the estimated signal-to-noise ratio and the estimated threshold level of speech loss distortion;

determining a second value for the reduction value based on reducing the energy level of the noise component in the sub-band signal to the residual noise target level; and selecting one of the first value and the second value as the reduction value.

10. The method of claim 8, wherein the residual noise target level is below an audible level.

11. The method of claim 4, wherein the reduction value is further based on estimated power spectral densities for the noise component and for a speech component in the sub-band signal.

12. A non-transitory computer readable storage medium having embodied thereon a program, the program being executable by a processor to perform a method for reducing noise within an acoustic signal, the method comprising:

separating the acoustic signal into a plurality of sub-band signals, the acoustic signal representing at least one captured sound; and reducing an energy level of a noise component in a sub-band signal in the plurality of sub-band signals, the reducing based on an estimated signal-to-noise ratio of the sub-band signal, and further based on an estimated threshold level of speech loss distortion in the sub-band signal.

13. The non-transitory computer readable storage medium of claim 12, wherein the reducing an energy level of a noise component in a sub-band signal in the plurality of sub-band signals comprises applying a reduction value to the sub-band signal.

14. The non-transitory computer readable storage medium of claim 13, wherein applying the reduction value comprises performing noise cancellation of the sub-band signal based on the reduction value.

15. The non-transitory computer readable storage medium of claim 13, wherein applying the reduction value comprises multiplying the reduction value to the sub-band signal.

16. The non-transitory computer readable storage medium of claim 13, wherein the energy level of the noise component in the sub-band signal is reduced to no less than a residual noise target level.

17. The non-transitory computer readable storage medium of claim 16, further comprising:

determining a first value for the reduction value based on the estimated signal-to-noise ratio and the estimated threshold level of speech loss distortion;

determining a second value for the reduction value based on reducing the energy level of the noise component in the sub-band signal to the residual noise target level; and selecting one of the first value and the second value as the reduction value.

18. The non-transitory computer readable storage medium of claim 13, further comprising multiplying another reduction value to the sub-band signal to further reduce the energy level of the noise component.

19. The non-transitory computer readable storage medium of claim 16, wherein the residual noise target level is below an audible level.

20. A system for reducing noise within an acoustic signal, comprising:

a frequency analysis module stored in memory and executed by at least one hardware processor to separate the acoustic signal into a plurality of sub-band signals, the acoustic signal representing at least one captured sound; and a noise reduction module stored in memory and executed by a processor to reduce an energy level of a noise component in a sub-band signal in the plurality of sub-band signals, the reducing based on an estimated signal-to-noise ratio of the sub-band signal, and further based on an estimated threshold level of speech loss distortion in the sub-band signal.

21. The system of claim 20, wherein the reducing an energy level of a noise component in a sub-band signal in the plurality of sub-band signals comprises applying a reduction value to the sub-band signal.

22. The system of claim 21, wherein the noise reduction module performs noise cancellation of the sub-band signal based on the reduction value.

* * * * *